US006192210B1

(12) United States Patent
Munenori et al.

(10) Patent No.: US 6,192,210 B1
(45) Date of Patent: Feb. 20, 2001

(54) BELT DRIVE DEVICE AND IMAGE FORMING APPARATUS EQUIPPED WITH SAID DEVICE

(75) Inventors: Seiichi Munenori, Toyokawa; Hiroki Yamashita, Okazaki; Hideyuki Kurahashi, Toyokawa; Tetsuya Onuki, Aichi-ken, all of (JP)

(73) Assignee: Minolta, Co., Ltd., Osaka (JP)

( * ) Notice: Under 35 U.S.C. 154(b), the term of this patent shall be extended for 0 days.

(21) Appl. No.: 09/447,261

(22) Filed: Nov. 23, 1999

(30) Foreign Application Priority Data

Nov. 24, 1998 (JP) ..... 10-333283

(51) Int. Cl.[7] ..... G03G 15/14; G03G 15/00
(52) U.S. Cl. ..... 399/165; 399/303
(58) Field of Search ..... 399/162, 165, 399/159, 303, 308, 313, 329; 198/804, 837

(56) References Cited

U.S. PATENT DOCUMENTS 5,017,969 * 5/1991 Mitomi et al. ..... 399/303 X
5,153,655 10/1992 Suzuki et al. ..... 399/329
5,343,279 8/1994 Nagata et al. ..... 399/329
5,387,962 * 2/1995 Castelli et al. ..... 399/165
5,422,706 * 6/1995 Tsunemi et al. ..... 399/159

FOREIGN PATENT DOCUMENTS 57-060346 * 4/1982 (JP) .

* cited by examiner

*Primary Examiner*—Sophia S. Chen
(74) *Attorney, Agent, or Firm*—Morrison & Foerster LLP

(57) ABSTRACT

A belt drive used in image forming apparatuses which minimizes the transverse movement of the belt across the length of a roller and prevents the riding up of the belt onto the roller. The belt drive device has a belt equipped with elastic guide members mounted on each edge or on the back surface of the belt near each edge. The belt is suspended over two or more rollers and driven by the drive belt. At least one of the rollers is a drive roller having a rotating member mounted between the elastic guide member and the roller end area such that the rotating members rotate independently of the roller.

22 Claims, 4 Drawing Sheets

BELT DRIVE DEVICE AND IMAGE FORMING APPARATUS EQUIPPED WITH SAID DEVICE

RELATED APPLICATION

This application is based on application No. Hei 10-333283 filed in Japan, the entire content of which is hereby incorporated by reference.

BACKGROUND OF THE INVENTION

1. Field of the Invention

The present invention pertains to a drive device for a continuous belt used in image forming apparatuses such as copying machines, printers, facsimile machines, and machines combining any of these functions.

2. Description of the Related Art

Apparatuses that form images on a sheet, such as copying machines, printers and facsimile machines, conventionally are equipped with mechanisms to rotate a continuous belt at various locations inside the apparatus. The continuous belts used in conjunction with such mechanisms include, for example, a transfer medium conveyance belt, a photoreceptor belt and an intermediate transfer belt.

A high degree of parallelism is required of the multiple rollers over which the belt is suspended and which cause the belt to rotate. If the rollers are not parallel, the belt shifts along the axes of the rollers and meanders as it rotates, resulting not only in poor quality images exhibiting mismatched color images, for example, but also in damage to the belt itself in some cases. One well known type of belt has parallel elastic guide members located at either edge of the bottom side of the belt in order to minimize the need for the rollers to be precisely parallel. In this type of belt drive device, belt shifting may be prevented by hooking the elastic guide members onto the end areas of the rollers.

However, the coefficient of friction between the elastic guide member and the roller end area is usually high, at 0.3 or more. Therefore, a meandering force is generated in the belt, and the elastic guide member is pushed out along the radius of the roller where the elastic guide member and the roller end area are in contact with each other. Consequently, the elastic guide member rides up on the roller, resulting in meandering of the belt and ultimately damage to the belt.

In order to reduce the friction between the elastic guide member and the roller end area, a belt drive device has been proposed in which the coefficient of friction between the elastic guide member and the roller end area is reduced by means of a coating (Japanese Laid-Open Patent Application Hei 6-51578).

However, the coating for this belt drive device is expensive. Moreover, the elastic guide members warp around the rollers, giving rise to the problems that the coating comes off easily and the life of the coating is short.

SUMMARY OF THE INVENTION

The object of the present invention is to resolve the problems described above.

Another object of the present invention is to provide a belt drive device that can prevent shifting and/or meandering of the belt.

Yet another object of the present invention is to provide a belt drive device that uses a belt having guide members on its edges, said belt drive device being capable of preventing the belt from shifting and riding up on the roller.

Yet another object of the present invention is to provide a belt drive device that can prevent the belt from shifting and/or meandering using a simple construction.

Yet another object of the present invention is to provide a belt drive device that can prevent the belt from shifting and/or meandering using inexpensive components.

These and other objects are attained by a belt drive device having a continuous belt, a plurality of rollers which suspends the belt and has a shaft, a guide member which is mounted on edge of the belt and regulates the shifting of the belt along the roller shaft, and a support member which is located between a roller end surface and the guide member.

The objects stated above are also attained by a belt drive device equipped to image forming apparatus having a belt which has hook portion on its side, a roller which suspends the belt, and a buffer which is located between said hook portion and said roller.

The invention itself, together with further objects and attendant advantages, will best be understood by reference to the following detailed description taken in conjunction with the accompanying drawings.

BRIEF DESCRIPTION OF THE DRAWINGS

In the following description, like parts are designated by like reference numbers throughout the several drawings.

DESCRIPTION OF THE PREFERRED EMBODIMENTS

The embodiments of the present invention are explained below with reference to the attached drawings.

Figure 1:
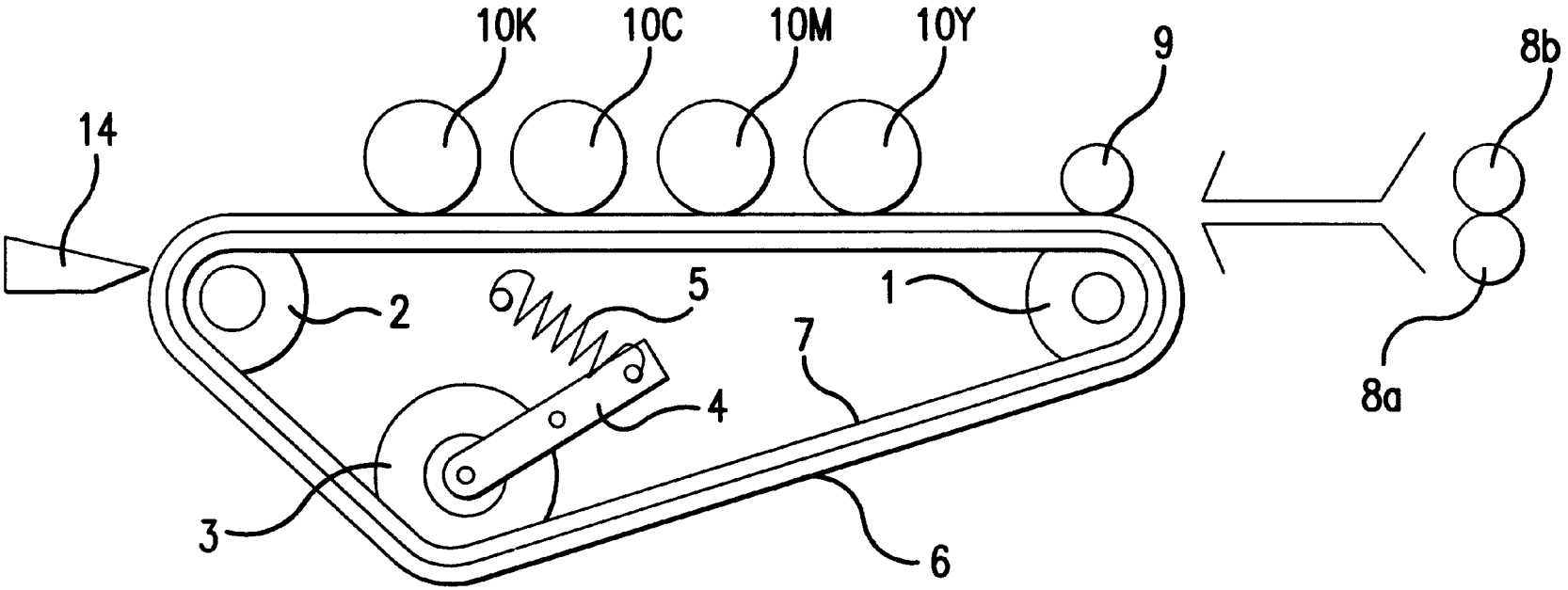
FIG. 1 is a side view showing a drive device for the transfer medium conveyance belt.

FIG. 1 shows the transfer medium conveyance belt of a tandem-style color printer. In FIG. 1, 1 is a drive roller, 2 is a driven roller, 3 is a tension roller to supply tension to the belt, 4 is a support member to support the tension roller 3 such that it can move, and 5 is a pull spring that acts on the support member 4. 6 is a transfer medium conveyance belt suspended around the drive roller 1, the driven roller 2 and the tension roller 3. 7 is an elastic guide member comprising an elastic material such as rubber. 10K, 10C, 10M and 10Y are photoreceptors that form toner images of various colors, i.e., yellow, magenta, cyan and black.

The formation of a color image on a sheet is carried out by means of the following process. The sheet fed out by resist rollers 8*a* and 8*b* that control the timing of the supply of sheets is adsorbed onto the belt 6 by means of the adsorption roller 9 to which a high voltage is impressed. Yellow, magenta, cyan and black toner images are formed on the photoreceptors 10 and sequentially transferred onto the sheet on the belt 6 driven by the drive roller 1. Finally, the sheet separated from the belt by means of the separation claw 14 is conveyed to the fusing device. Therefore, if the transfer medium conveyance belt 6 shifts or meanders on the rollers, the images formed on the conveyed sheet do not match.

Figure 2:
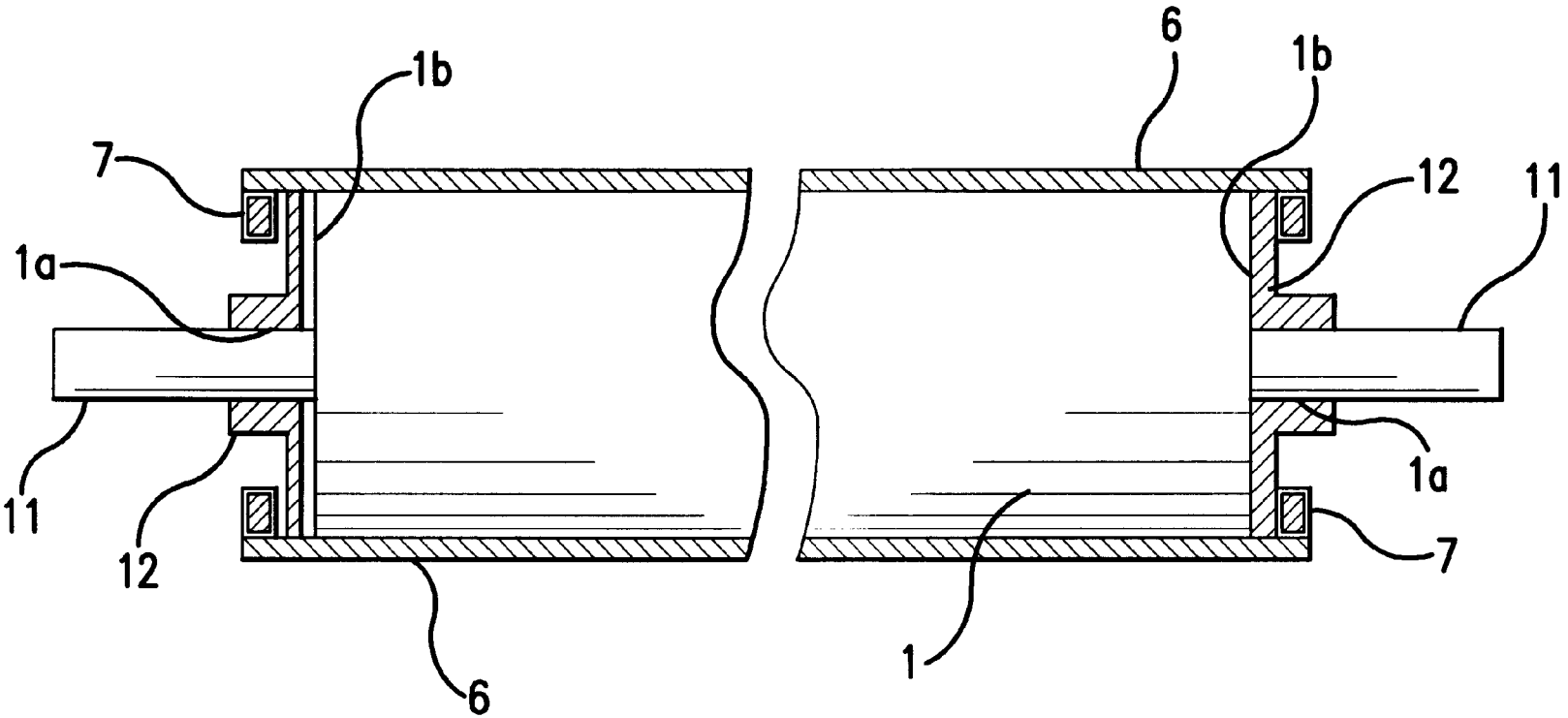
FIG. 2 is a cross-sectional view showing a drive roller.
Figure 3:
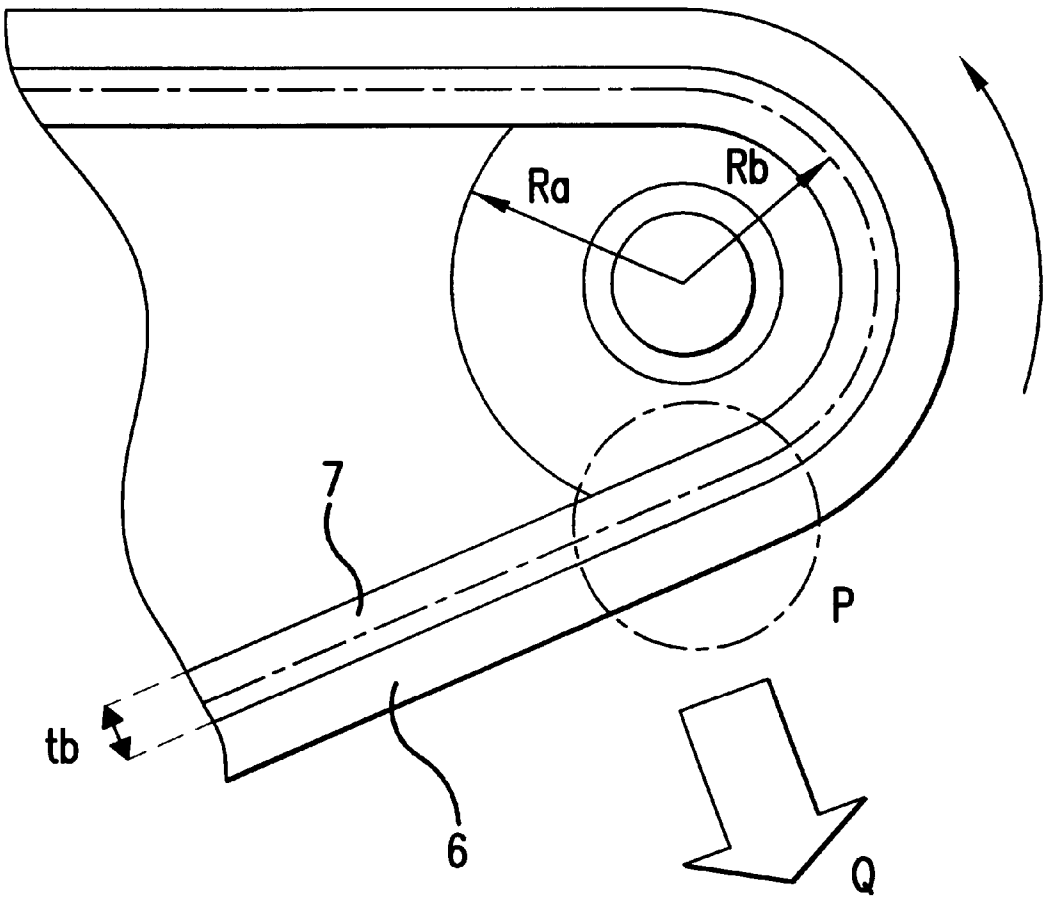
FIG. 3 is a drawing showing the area where the belt having an elastic guide member is in contact with the drive roller.

FIG. 2 is an outline drawing showing one embodiment of the belt drive device pertaining to the present invention. Between the drive roller 1 and the elastic guide members 7 adhering to the edge of the transfer medium conveyance belt 6 is mounted a flange 12 that can rotate around the roller shaft 1*a* and relative to end area (end surface 1*b* and shaft 1*a*) of the drive roller 1. FIG. 3 shows the area where the belt having the elastic guide members is in contact with the drive roller.

It is empirically known that the riding of the belt on the roller tends to take place at the area where the elastic guide member 7 comes in contact with the roller. The reason for this is explained with reference to FIG. 3. The belt 6 and drive roller 1 rotate in the direction of the arrow in the drawing. The area P in the drawing is the area at which the belt 6 and elastic guide member 7 come in contact with the drive roller 1.

The riding of the belt 6 on the drive roller in the area P occurs easily due to the difference in speed between the elastic guide member 7 and the part of the drive roller that is in contact with the elastic guide member in the area P. In other words, the speed of the elastic guide member 7 at the area P is the peripheral velocity of the drive roller 1 $Vk=2\times Ra\times\pi\times n$ (n: rotation rate of the drive roller), and the speed of the part of the drive roller that is in contact with the elastic guide member is $Vr=2\times Rb\times\pi\times n$ (n: rotation rate of the drive roller), which is different from the speed of the elastic guide member 7. Further, the friction coefficient of the elastic guide member 7 is relatively high. For example, where regular rubber is used for the belt 6 and aluminum is used for the drive roller 1, the friction coefficient is 0.5 or more. A frictional force is generated due to the correlation between the difference in speed and the high friction coefficient, and the belt is pushed up in the direction Q. Finally, the elastic guide member 7 rides up on the drive roller.

Based on this mechanism, if the speed of the elastic guide member 7 and that of the part of the drive roller that is in contact with the elastic guide member are equal at the area P, the riding of the elastic guide member 7 may be prevented.

With reference to FIGS. 2 and 3, the mechanism that prevents the guide member 7 from riding up on the drive roller 1 is explained. The transfer medium conveyance belt 6 tends to move in a direction parallel to the length of the roller due to the loss of parallelism among the drive roller 1, driven roller 2 and tension roller 3, and the imbalance in the tension supplied by the tension roller 3. When this occurs, however, the elastic guide member 7 with width tb hooks onto the roller end area and tries to stop this movement. Between the end surface 1*b* of the drive roller 1 and the elastic guide member 7 is a rotating member that can move relative to the end are of the drive roller 1 (the roller end surface 1*b* and roller shaft 1*a*). In this embodiment, this rotating member comprises a flange 12 having a flange configuration, which is formed using a material that allows easy movement relative to the roller end area, such as POM (polyacetal). As shown in FIGS. 2 and 3, the outer diameter of this flange 12 matches the outer diameter of the roller cross-section. The flange 12 is located around the roller shaft such that it may rotate around the roller shaft.

The friction between the end surface of the drive roller 1 and the flange 12 is designed to be smaller than the friction between the flange 12 and the elastic guide member 7. Therefore, when the elastic guide member 7 is in contact with the flange 12 and the flange 12 is in contact with the roller end surface 1*b*, the flange 12 rotates together with the elastic guide member 7 and slides against the roller end surface 1*b*. Because this flange 12 is located in this way, the speed of the elastic guide member 7 and the speed of the area of the flange 12 that is in contact with the elastic guide member may be made equal in the area P shown in FIG. 3. Incidentally, when this occurs, the drive roller 1 and the flange 12 rotate at different rotation speeds.

Figure 4:
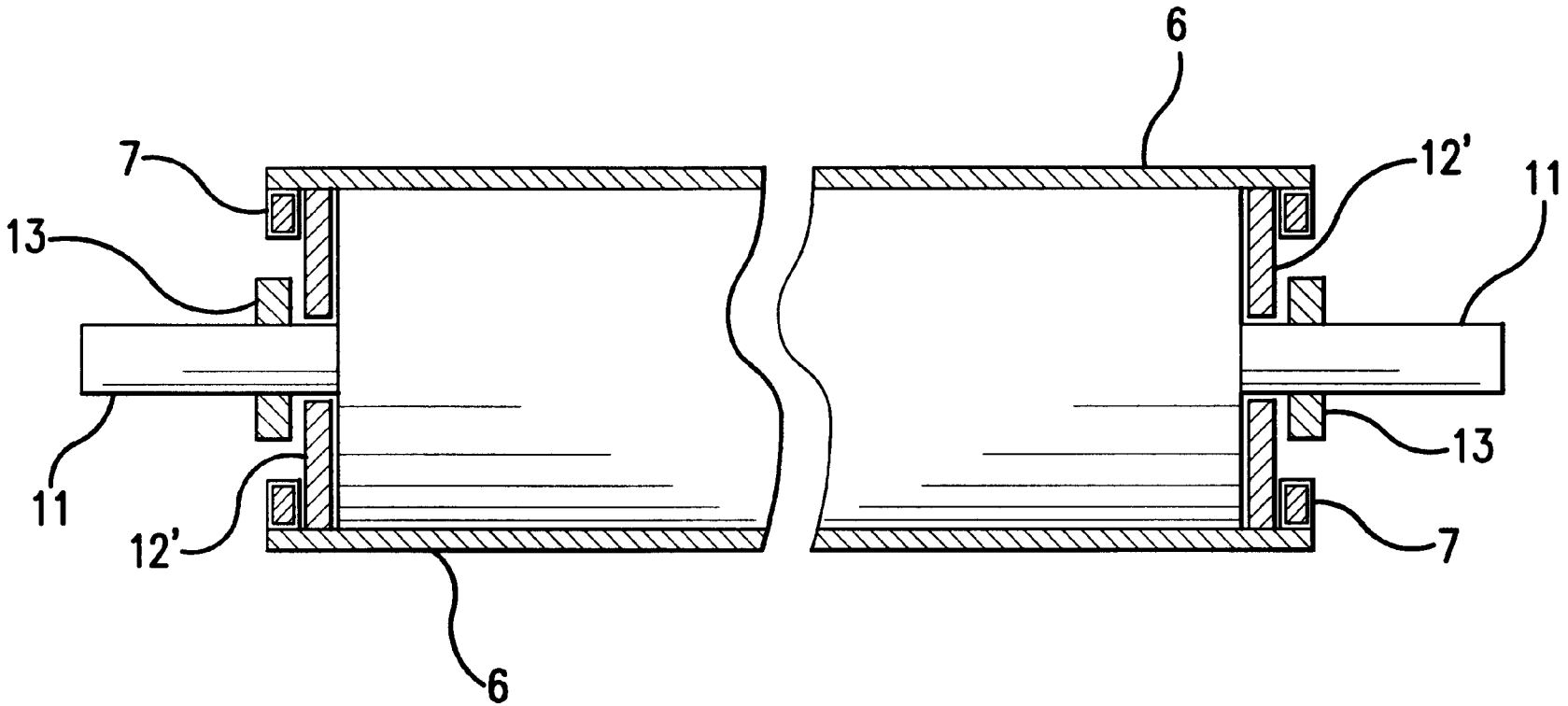
FIG. 4 is a cross-sectional view showing a drive roller.

FIG. 4 is a summary drawing showing another embodiment pertaining to the present invention. This embodiment is identical to the previous embodiment except that the rotating member comprises a flat ring 12'. The flat ring 12' is placed around the roller shaft and has a circumference that matches the roller circumference. 13 is a stopper fixed to the roller shaft. The stopper 13 is fixed to the roller shaft with a small gap separating it from the flat rotating member that is in contact with the roller. This flat ring 12' is made of a material that allows easy movement relative to the roller end area (the roller end surface and roller shaft), such as POM, like the flange described above. The stopper 13 may be omitted, but its use is preferable from a safety standpoint. The frictional relationships among the roller end surface 1*b*, the flat ring 12' and the elastic guide member 7 are the same as in the previous embodiment. This construction also has the same functions as the embodiment shown in FIG. 3 and operates in the same manner.

The riding up of the elastic guide member 7 is prevented and the shifting of the entire belt is controlled in this way. The flange 12 and flat ring 12' are molded using POM, etc., and are therefore inexpensive. In addition, since they are simply placed around the roller shaft of the drive roller, offering a simple construction, a highly reliable belt drive device may be provided. Further, if the frictional resistance of the flange 12 and flat ring 12' against the elastic guide member 7 is low, the riding up of the belt may be more effectively prevented.

The embodiments were explained with relation to the drive roller 1 only, but the same construction may be used in relation with the driven roller 2 or the tension roller 3. In addition, in order to resolve the problem of the riding up of the belt more reliably, it is preferred that this construction be adopted for all rollers over which the belt is suspended.

Further, the explanations regarding the embodiments described above were provided in terms of a transfer medium conveyance belt in a tandem color printer, but the application of the belt drive device is not limited to the transfer medium conveyance belt. It may be effectively applied with a photoreceptor belt or intermediate transfer belt as well. A transfer medium conveyance belt is generally used in color machines. A color image is formed by having the belt electrostatically adsorb and convey the sheet so that it can sequentially come into contact with the yellow, magenta, cyan and black rotating photoreceptor drums that each carry a toner image such that these toner images are transferred onto the sheet. With a photoreceptor belt, a latent image is formed when light is irradiated onto its photoconductive surface, and toner is statically held onto this latent image, whereby a toner image is formed. An intermediate transfer belt holds the visible toner image formed on the photoreceptor and transfers the toner image onto the sheet in the subsequent rotation. Image forming apparatuses using the direct recording method are also known, in which the toner image is directly formed on the sheet carried on the transfer medium conveyance belt or the intermediate transfer means. Further, the image forming apparatus may be a color device or monochrome device. The method used is also not limited to electrostatic photography, and may comprise the direct recording method as well.

In the embodiments explained above, a flange or flat ring that can move in the direction of rotation was mounted between the guide member of the belt and the end area of the roller. This prevents the guide member from being pushed outward in the direction of the radius of the roller and riding up on the roller due to the friction that occurs due to the difference in speed between the guide member and the area of the roller that is in contact with the guide member at the area where the guide member comes into contact with the roller end area. Further, the flange 12 or flat ring 12' are molded of a materials such as POM, and are therefore inexpensive and offer a simple construction in which they are simply placed around the roller shaft. Consequently, a highly reliable belt drive device may be provided.

Although the present invention has been fully described by way of examples with reference to the accompanying drawings, it is to be noted that various changes and modifications will be apparent to those skilled in the art. Therefore, unless such changes and modifications depart from the scope of the present invention, they should be constructed as being included therein.

What is claimed is:

1. A belt drive device comprising:

a continuous belt;

a plurality of rollers which suspends the belt;

a guide member which is mounted on an edge of at least one side of the belt to regulate a lateral shifting of the belt along the plurality of rollers; and a support member which is disposed between an end surface of at least one roller of the plurality of rollers and the guide member, wherein a friction between the end surface and the support member is smaller than a friction between the support member and the guide member.

2. The belt drive device according to claim 1, wherein said support member moves with contacting with the roller end surface.

3. The belt drive device according to claim 1, wherein said guide member regulates the lateral shifting of the belt by hooking onto the support member.

4. The belt drive device according to claim 1, wherein the belt drive device has the support member at each end surface of at least one roller of the plurality of rollers.

5. The belt drive device according to claim 1, wherein one of the plurality of rollers is a drive roller.

6. The belt drive device according to claim 5, wherein said support member is located on each end of said drive roller.

7. The belt drive device according to claim 1, wherein the continuous belt is for holding a sheet.

8. The belt drive device according to claim 7, wherein said continuous belt is a transfer medium conveyance belt, a photoreceptor belt, or an intermediate transfer belt.

9. The belt drive device according to claim 1, wherein the support member is disposed on at least one end surface of all the plurality of rollers.

10. The belt drive device according to claim 1, wherein the support member is disposed on each end surface of all the plurality of rollers.

11. The belt drive device according to claim 1, wherein said at least one roller of the plurality of rollers has a shaft protruding from each end surface of said at least one roller, said support member is capable of rotation round said shaft.

12. The belt drive device according to claim 11, wherein said support member is formed as a flange.

13. The belt drive device according to claim 11, wherein said support member is formed as a flat ring.

14. The belt drive device according to claim 11, wherein said support member is placed around said shaft.

15. The belt drive device according to claim 1, wherein said guide member is mounted on edge of an inner surface of the belt.

16. A belt drive device adapted to be equipped on an image forming apparatus, comprising:

a belt which has a hook portion on one of its sides;

a roller which suspends the belt; and a buffer which is located between said hook portion and an end surface of said roller, wherein a frictional resistance between said buffer and said hook portion is less than a frictional resistance between said buffer and end surface of said roller, said buffer capable of rotating independently of said roller.

17. The belt drive device according to claim 16, wherein said buffer contacts said hook portion and said roller.

18. The belt drive device according to claim 17, wherein said buffer contacts an end area of said roller and is slippery to the end area.

19. The belt drive device according to claim 18, wherein a frictional resistance of said buffer against said hook portion is lower than against the end area.

20. The belt drive device according to claim 19, wherein the hook portion free from being pushed outward in a direction of a radius of the roller and riding up on the roller due to a friction that occurs due to a difference in speed between the hook portion and an area of the roller that is in contact with the hook portion at an area where the hook portion comes into contact with the roller end area.

21. A belt drive device adapted to be equipped on an image forming apparatus, comprising:

a belt which has a hook portion on each of its sides;

a first roller which suspends the belt; and a buffer which is disposed between said hook portion and each end surface of said roller.

22. A belt drive device according to claim 21, further comprising a second roller which suspends the belt and supplies tension to the belt in cooperation with said first roller.

* * * * *